United States Patent [19]

Gilbert et al.

[11] Patent Number: 4,474,315

[45] Date of Patent: Oct. 2, 1984

[54] MOLTEN METAL TRANSFER DEVICE

[75] Inventors: Ronald E. Gilbert, Chardon; George S. Mordue, Ravenna, both of Ohio

[73] Assignee: Kennecott Corporation, Cleveland, Ohio

[21] Appl. No.: 368,703

[22] Filed: Apr. 15, 1982

[51] Int. Cl.[3] ..... B22D 41/00

[52] U.S. Cl. ..... 222/629; 222/591; 222/305; 222/356

[58] Field of Search ..... 222/590, 591, 594, 598, 222/599, 596, 629, 282, 288, 305, 309, 356, 358, 344, 361, 189, 131; 164/335; 266/227

[56] References Cited

U.S. PATENT DOCUMENTS

| | | | |
|---|---|---|---|
| 907,274 | 12/1908 | Neureuther | 222/356 |
| 2,561,111 | 7/1951 | Grote | 222/336 |
| 3,261,060 | 7/1966 | McAlpine et al. | 222/361 |
| 3,618,831 | 11/1971 | Goodwin | 222/596 |
| 3,869,282 | 3/1975 | Curran et al. | 266/227 |
| 4,078,706 | 3/1978 | Hanuszczak | 222/596 |
| 4,356,940 | 11/1982 | Ansorge | 222/596 |
| 4,425,932 | 1/1984 | Herman | 222/590 X |

FOREIGN PATENT DOCUMENTS 651891 9/1937 Fed. Rep. of Germany ..... 222/356

*Primary Examiner*—Joseph J. Rolla
*Assistant Examiner*—George S. Pyryt
*Attorney, Agent, or Firm*—R. Lawrence Sahr

[57] ABSTRACT

A molten metal transfer device for withdrawing a selected quantity of molten metal from a bath includes structure defining a chamber disposed within the bath, the chamber including a first opening through which molten metal can flow from the bath into the chamber and a second opening through which molten metal can flow outwardly from the chamber. A cup-like bucket is disposed within the chamber for vertical reciprocating movement, the bucket having a generally vertically oriented slot included as part of its sidewall. The device includes a displacement mechanism for urging the bucket laterally toward engagement with the surface of the chamber. The device also includes mechanisms for easily removing buckets and chambers and replacing them with new buckets and chambers.

43 Claims, 14 Drawing Figures

84
90
86
100
120
118
98
10
80
116
126
102
124
122
92
106
104
142
96
112
132
144
130
110
138
152
156
108
134
140
148
146
154
114
6
158
6
170
72
112
136
176
168
190
150
160
38
74
188
50
164
166
48
30
46
184
36
182
34
162
178
32
20
26
68
22
24
60
28
66
64
70
62

MOLTEN METAL TRANSFER DEVICE

CROSS-REFERENCE TO RELATED APPLICATION

CORROSION AND WEAR RESISTANT GRAPHITE MATERIAL AND METHOD OF MANUFACTURE, patent application Ser. No. 368,700, filed concurrently by R. C. Chandler, et al., here the "Graphite Material Patent."

BACKGROUND OF THE INVENTION

1. Field of the Invention

The invention relates to molten metal transfer devices and, more particularly, to such a device wherein the amount of material delivered by the device can be adjusted readily and wherein components of the system can be changed readily.

2. Description of the Prior Art

Molten metal transfer devices (commonly known as shot pumps) are used to withdraw a quantity of molten metal from a bath and deliver the molten metal for purposes such as forming castings. Particularly in the casting of metals such as aluminum, shot pumps have included a chamber disposed within a bath of molten metal. The chambers have been oriented generally vertically and cup-like buckets have been disposed within the chambers for reciprocating vertical movement. The chambers have included appropriate openings such that molten metal from the bath can flow into the chamber and into the bucket; upon raising the bucket, molten metal carried by the bucket can be lifted to a location where the metal can be discharged from the chamber for transfer to casting equipment.

Although prior shot pumps have enabled molten metal to be removed from a bath in separate, small quantities, certain problems have not been addressed. One of these problems relates to precisely controlling the amount of material withdrawn from the bath with each cycle of the pump. One known prior shot pump employs a wedge-shaped piston disposed within a cylinder. Molten metal is permitted to flow into the cylinder and accumulate atop the piston. Thereafter, upon raising the piston, molten metal trapped above the piston is lifted upwardly and can be discharged outwardly from the cylinder. Unfortunately, the shape of the piston and various other parameters of the pump make it very difficult to adjust, with any degree of accuracy, the amount of material delivered with each cycle of the pump.

Another known device employs a cup-like bucket having an opening formed near the bottom of the bucket. When the bucket is raised to a certain position within a chamber, molten metal carried by the bucket is permitted to flow outwardly through the opening. As with the earlier described device, the amount of material carried by the bucket and ultimately discharged from the bucket is very difficult to control.

Another problem not addressed by proper shot pumps is that of a proper relationship between the size of the bucket and the chamber within which the bucket is disposed. In prior pumps, if a close-fitting relationship has been provided between the bucket and the chamber, adequate sealing characteristics will be provided, but excessive wear may occur and it will be difficult, if not impossible, for the bucket to be removed from the chamber and replaced from time to time. On the other hand, if a loose-fitting relationship between the bucket and the chamber is provided, adequate sealing characteristics will not be available.

Additional problems not addressed by prior shot pumps include the capability of removing the bucket from the chamber and replacing it quickly with another bucket. Prior shot pumps have required considerable down-time and reconfiguration of the pump in order to make such a change. Yet an additional problem not addressed by prior shot pumps is that of changing a chamber and bucket assembly when it is desired to significantly alter the quantity of metal being removed from the bath.

SUMMARY OF THE INVENTION

The present invention overcomes the foregoing and other deficiencies of prior art molten metal transfer devices by providing such a device wherein a cup-like bucket disposed within a chamber includes a sidewall and a bottom, as well as a generally vertically oriented slot included as part of the sidewall. The chamber is adapted to have a portion disposed within a bath of molten metal. A first opening included as part of the chamber permits molten metal to flow from the bath into the chamber. A second opening is positioned at a vertical location above the first opening and permits molten metal to flow outwardly from the chamber. In use, the bucket is displaced downwardly to a lowermost position where molten metal flows into the bucket through the first opening. Upon vertical movement of the bucket to an uppermost position adjacent the second opening, molten metal carried by the bucket is permitted to flow outwardly from the bucket through the second opening.

Because the vertically oriented slot extends from the bottom of the bucket to the upper edge of the bucket, the amount of material permitted to flow outwardly of the bucket is dependent upon the position of the bucket relative to the second opening. An actuator is provided for the bucket, and a limit switch is provided to control operation of the actuator. By appropriate adjustment of the limit switch, the bucket can be raised to a predetermined position, whereupon a selected quantity of molten metal will be discharged from the bucket. The amount of material delivered by the device can be controlled accurately, because the amount of material delivered from the device is a linear function of the position of the bucket relative to the second opening. This feature represents a significant improvement over known prior devices, all of which have required considerable trial and error adjustment before the quantity of material delivered from the device is as desired.

It has been found that most effective operation of the device can result if a biasing means is provided to constantly urge the bucket laterally toward engagement with the chamber at a location adjacent the vertically oriented slot. That is, it is necessary to provide a good seal only in the region of the slot, and other portions of the bucket do not need to be brought into contact with the chamber. Accordingly, a significant gap, on the order of one quarter inch, can be provided between the chamber and the bucket at locations other than in the region of the slot. In turn, when it is desired to change buckets, little or no difficulty will be presented in removing the bucket from the chamber, even if deposits of metal have accumulated. Moreover, wear problems associated with prior shot pumps largely have been eliminated by the foregoing relationship between the bucket and the chamber.

The invention includes other features that facilitate operation of the device. An actuator is provided for the bucket, and a shaft connects the bucket to the actuator. A detachable connection is provided for the shaft and the actuator, and a pivotal mount is provided for the actuator such that, upon disconnecting the shaft and the actuator, the actuator can be moved away from the region of the chamber. Thereafter, the bucket can be removed from the chamber without interfering with the actuator. This construction greatly facilitates removing and replacing buckets.

The invention also includes a clamp which encircles the chamber and secures the chamber to the remainder of the device. When it is desired to change chamber sizes (in order to significantly increase or decrease the amount of metal which may be delivered from the device), it is necessary only that the clamp and its associated chamber be removed from the device. Another chamber with an appropriate clamp can be substituted readily.

The invention also includes a downspout secured to the structure and positioned in superimposed relationship with respect to the first opening. By this construction, molten metal from the bath is required to enter the chamber from beneath the surface of the molten metal, thereby minimizing the amount of impurities floating on the surface of the molten metal which are enabled to enter the chamber. In order to further minimize difficulties associated with impurities entering the chamber, a porous filter medium may be provided for the first opening. Impurities will be trapped by the medium and prevented from entering the chamber.

By use of a molten metal transfer device according to the invention, the amount of molten metal delivered by the device can be adjusted readily and quite accurately. Individual buckets can be substituted readily and, if necessary, bucket and chamber assemblies also can be substituted readily. These and other features and advantages, and a fuller understanding of the invention, may be had by referring to the following description and claims, taken in conjunction with the accompanying drawings.

DESCRIPTION OF THE PREFERRED EMBODIMENT

Figure 1:
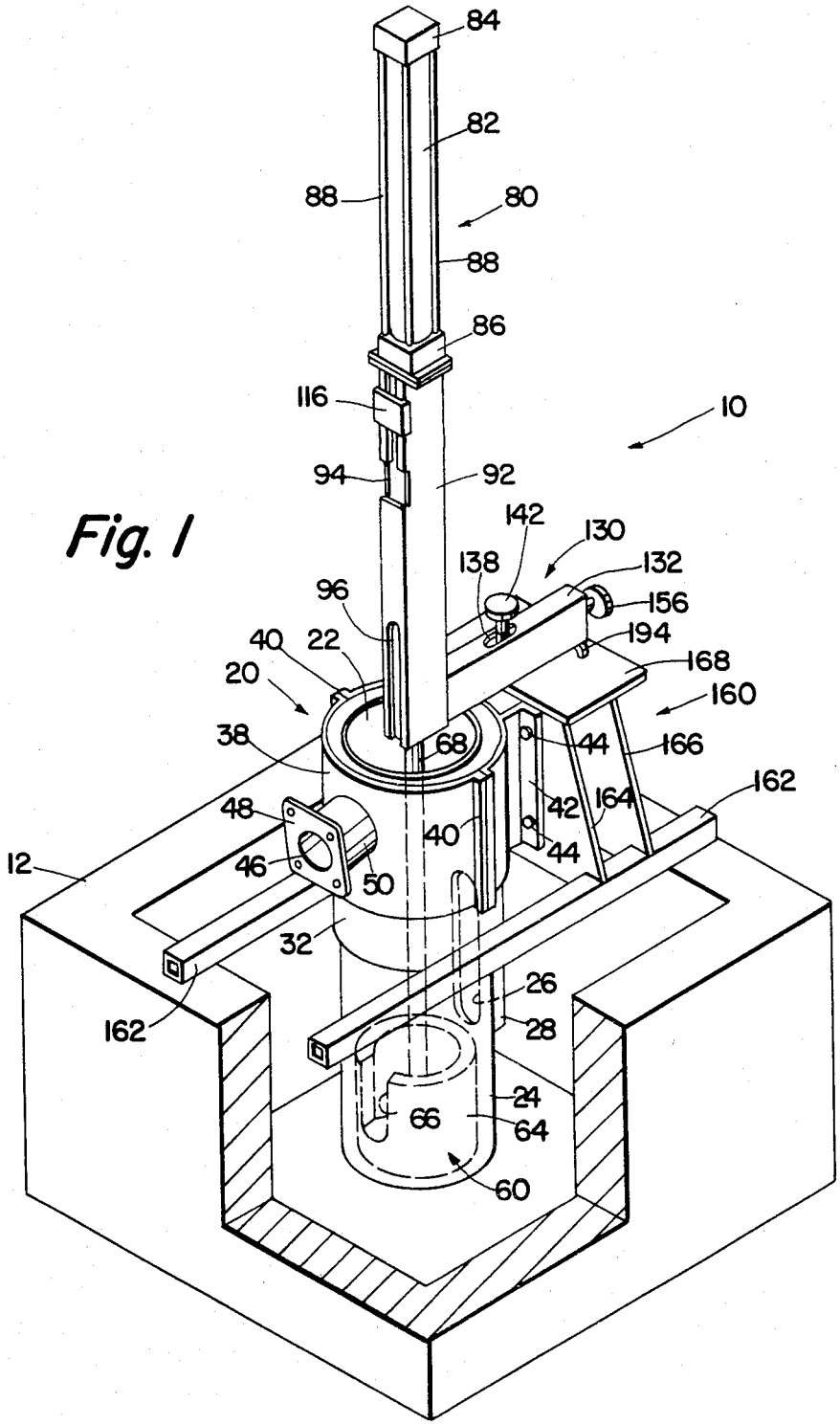
FIG. 1 is a perspective view of a molten metal transfer device according to the invention with certain parts broken away and removed, the device being suspended within a bath of molten metal.

Referring to FIG. 1, a molten metal transfer device according to the invention is indicated by the reference numeral 10. The device 10 is positioned such that its longer dimension is oriented vertically, and the device 10 is disposed within a bath 12 which may be filled with material such as molten aluminum. The device 10 includes a structure 20 defining a chamber 22, a cup-like bucket 60 disposed within the chamber 22 for reciprocating, vertical movement therein, an actuator 80 for displacing the bucket 60, mounting means 130 for the actuator 80, and a support structure 160.

The device 10 is of the type wherein molten metal is permitted to fill the bucket 60 when the bucket 60 is at its lowermost position within the chamber 22. Thereafter, upon lifting the bucket to an uppermost position within the chamber 22, molten metal will be permitted to flow outwardly of the bucket 60 and the chamber 22 for various uses such as forming castings. The components of the device and their function will be described individually.

I. The Structure 20

Referring particularly to FIGS. 2–6, the structure 20 includes an elongate, open-ended cylinder 24, the interior of which defines the chamber 22. The cylinder 24 is formed of a highly corrosion and erosion-resistant material such as that disclosed in the Graphite Material Patent. As is explained more fully in the graphite material patent, the cylinder 24 is capable of withstanding the high temperatures and corrosive characteristics of molten aluminum.

The cylinder 24 includes a first opening 26 through which molten metal can flow from the bath 12 into the chamber 22. The first opening 26 is elongate and is generally vertically oriented. The uppermost portion of the opening 26 is located such that it will be above the surface of molten metal disposed within the bath 12, while other portions of the opening 26 will be disposed below the surface of the molten metal, as will be other portions of the cylinder 24. A downspout 28 is secured to an outer portion of the cylinder 24 in superimposed relationship with respect to the first opening 26. The downspout 28 is spaced a short distance from the first opening 26. In use, the downspout 28 extends into the molten metal a sufficient distance that metal entering the chamber 22 is required to flow from beneath the surface of the metal, thereby greatly minimizing the quantity of impurities floating on the surface of the metal that are permitted to enter the chamber 22.

The cylinder 24 includes a second opening 30 through which molten metal can flow outwardly from the chamber 22. The second opening 30 is located at a vertical position above that of the first opening 26. In order to better insulate the cylinder 24, an encircling, heat-resistant, two-piece collar 32 is fitted about the upper end of the cylinder 24. The collar 32 preferably is made of a material such as aluminosilicate fibers. The collar 32 includes, on its inner surface, a circumferential groove 34 within which a circumferential rim 36 included as part of the cylinder 24 is fitted. The interaction of the groove 34 and the rim 36 prevent relative movement between the cylinder 24 and the collar 32.

The collar 32 is held together by a multi-part clamp tube 38. The clamp tube 38 includes outwardly extending clamp bars 40 held together by bolted fasteners 41. In order to mount the cylinder 24 to the support structure 160, the clamp tube 38 includes a pair of mounting angles 42 extending outwardly of the clamp tube 38. The angles 42 are secured to the structure 160 by means by bolted fasteners 44. Upon removing the fasteners 44, the structure 20 can be removed quickly from the device 10 and another structure 20 can be substituted.

The clamp tube 38 also includes an outwardly extending nozzle liner 46 to which a flange 48 is secured at the end. A nozzle pipe 50 surrounds the liner 46 and provides support for the liner 46. As will be apparent from examination of FIGS. 5 and 6, the liner 46 is located adjacent the second opening 30, thereby permitting molten metal to flow directly from the second opening 30 into the liner 46.

II. The Bucket 60

The bucket 60 is generally cup-like and includes a bottom portion 62 and a sidewall 64. A generally vertically oriented slot 66 is included as part of the sidewall 64. The slot 66 extends from the bottom of the bucket 60 to the upper edge of the bucket 60. The width of the slot 66 is constant along its length. A shaft 68 is concentrically disposed within the bucket 60 and extends vertically upwardly for connection to the actuator 80. The shaft 68 is secured to the bottom 62 by means of a roll pin 70. The shaft 68 is necked-down at its upper end as at 72 and includes an opening 74.

The bucket 60, like the cylinder 24, is manufactured from a material like that disclosed in the Graphite Material Patent. The wear-resistant characteristics of the shaft 68 are not particularly important, and it is preferred that the shaft 68 be manufactured from cold drawn steel.

III. The Actuator 80

The actuator 80 is connected to the bucket 60 by way of the shaft 68 and enables the bucket 60 to be reciprocated vertically within the cylinder 24. The actuator 80 includes a pneumatic cylinder 82 having end caps 84, 86 connected to each other by bolts 88. A quick disconnect plug 90 enables compressed air to be supplied to the cylinder 82 from a conventional source of compressed air (not shown).

The cylinder 82 is secured atop a tube 92 having longitudinally extending openings 94, 96. A plate 98 is secured atop the tube 92 and provides a place for the cylinder 82 to be connected thereto by means of bolted fasteners 100. An actuator rod 102 extends outwardly of the cylinder 82 and is disposed within the tube 92. The actuator rod 102 carries an intermediate shaft 104 having a tapered shoulder 106. A guide block 108 is connected to a necked-down portion of the intermediate shaft 104 by means of set screws 110. The guide block 108 includes a pair of spaced bearings 112 adapted to ride against the inner surface of the tube 92 at a location closest to the mounting means 130. The end of the guide block 108 opposite that to which the shaft 104 is secured receives the necked-down end 72 of the shaft 68. The necked-down 72 is secured to the guide block 108 by means of set screws 114.

The actuator 80 also includes a limit switch 116. The limit switch 116 is secured to the tube 92 and projects through the opening 94. The limit switch 116 is secured to an outer clamp 118 by means of machine screws 120. An inner clamp 122 is fitted on the inner surface of the tube 92. A bolted fastener 124 connects the outer and inner clamps 118, 122 so as to secure the limit switch 116 in a desired vertical position relative to the tube 92. By loosening the bolts 124, the limit switch 116 can be moved vertically within the opening 94.

The limit switch 116 also includes a plunger 126. The plunger 126 is positioned adjacent the actuator rod 102. In use, the plunger 126 periodically is contacted by the tapered shoulder 106 of the shaft 104. In turn, the limit switch 116 is activated. By connecting the limit switch 116 and the cylinder 82 as is well known in the art, the actuator 80 can be controlled. As will be apparent from an examination of FIGS. 1 and 5, vertical adjustment of the limit switch 116 relative to the tube 92 will enable the uppermost position attained by the actuator rod 102 to be adjusted as desired. In turn, because the bucket 60 is connected to the rod 102 by way of the shaft 68 and the guide block 108, the uppermost position attained by the bucket 60 can be adjusted as desired.

IV. The Actuator Mounting Means 130

The actuator mounting means 130 includes a tube 132 secured to the tube 92 at the base thereof. The tubes 90, 132 are at right angles to each other such that, in use, the tube 92 is oriented generally vertically, while the tube 132 is oriented generally horizontally.

An inner guide bar 134 is disposed within the tube 132 along its bottom, while an outer guide bar 136 is disposed on the underside of the tube 132 at a location adjacent the inner guide bar 134.

An opeing 138 is formed in the upper surface of the tube 132 at about its mid-point. A clamp screw 140 extends downwardly through the opening 138. A necked-down end portion of the clamp screw 140 extends through openings formed in the bars 134, 136. The upper end of the clamp screw 140 includes a knob 142 secured thereto by means of a roll pin 144.

Figure 6:
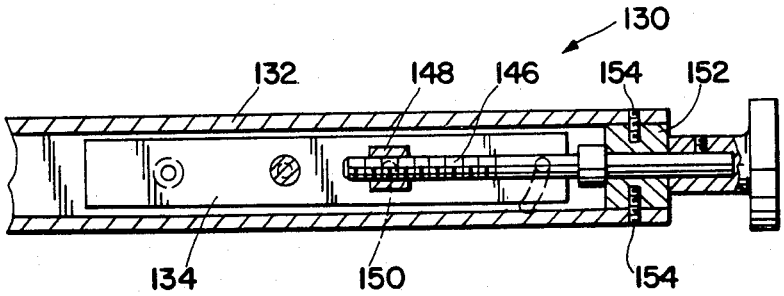
FIG. 6 is a cross-sectional view of a portion of the device according to the invention, taken along a plane indicated by line 6—6 in FIG. 5.
Figure 5:
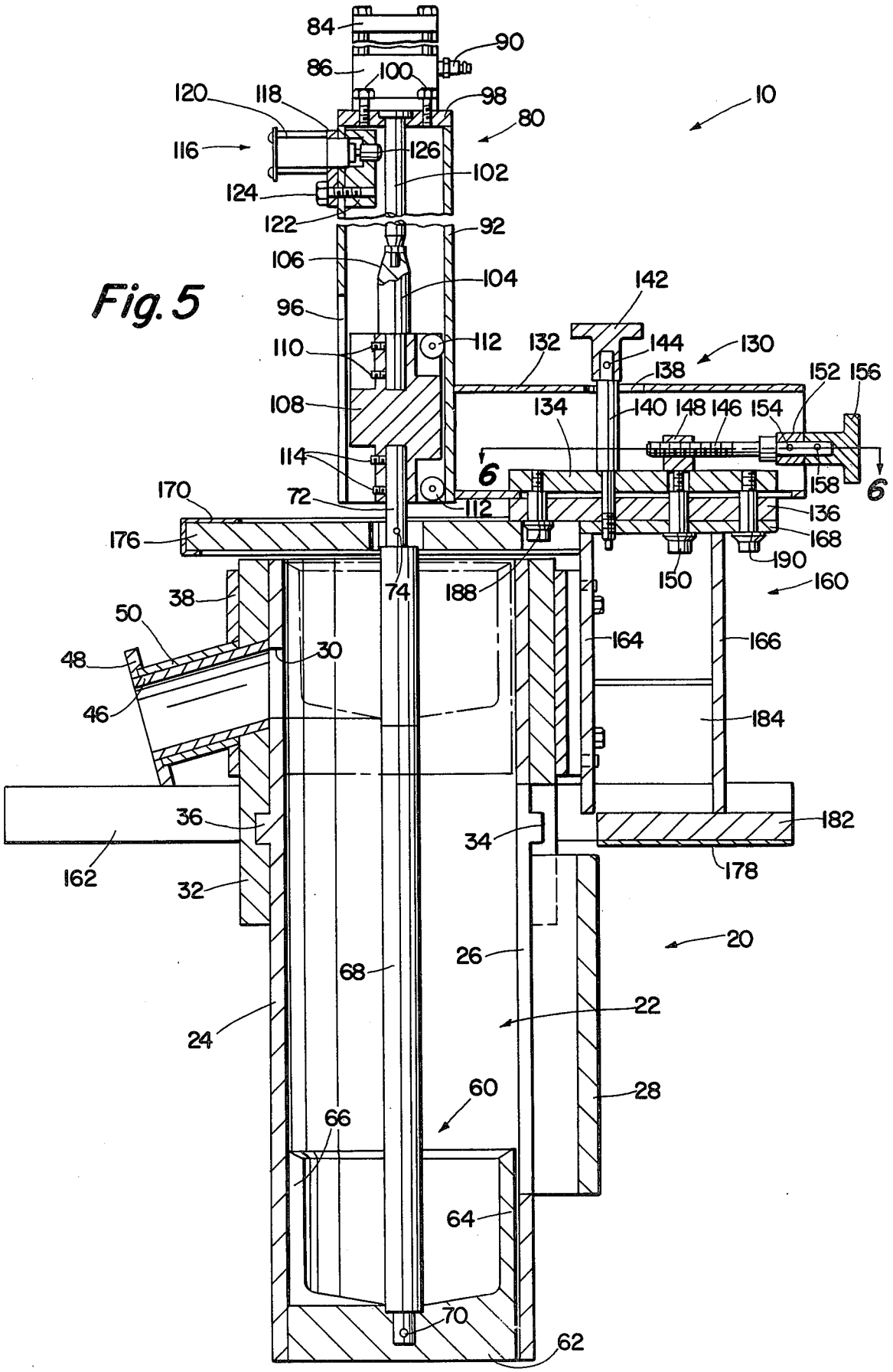
FIG. 5 is a cross-sectional view of the device according to the invention, taken along a plane indicated by line 5—5 in FIG. 4.

Referring particularly to FIGS. 5 and 6, a preload screw 146 is disposed within the end of the tube 132 opposite that end connected to the tube 92. The end of the screw 146 is threadedly engaged with a preload nut 148. The nut 148 is held in a stationary position relative to the guide bar 134 by means of a bolt 150 extending through the guide bars 134, 136. The other end of the screw 146 is supported for roation by means of a cross piece 152. The cross piece 152 is secured to the tube 132 by means of roll pins 154. A knob 156 is secured to the end of the screw 146 by means of a roll pin 158.

V. The Support Structure 160

The support structure 160 includes a pair of spaced cross bars 162 extending across the upper edge of the bath 12. Spaced, upright plates 164, 166 are secured to the cross bars 162 by means of welds. A horizontally disposed mounting plate 168 is secured atop the plates 164, 166 by means of welds. Referring to FIGS. 2–6, heat shield 170, 172 are secured atop the mounting plate 168 by means of fasteners 174. Referring particularly to FIG. 5, an insulator panel 176 is carried by each of the shields 170, 172 and is disposed above the structure 20. A lower heat shield 178 is secured to the cross bars 162 by means of roll pins 180. An insulator panel 182 is carried by the shield 178 and is disposed adjacent an intermediate portion of the structure 20, directly beneath the plates 164, 166.

A pair of gussets 184, 186 are secured to the plates 164, 166 in order to stabilize the plates. The gussets 184, 186 also are secured to the cross bars 162.

Figure 3:
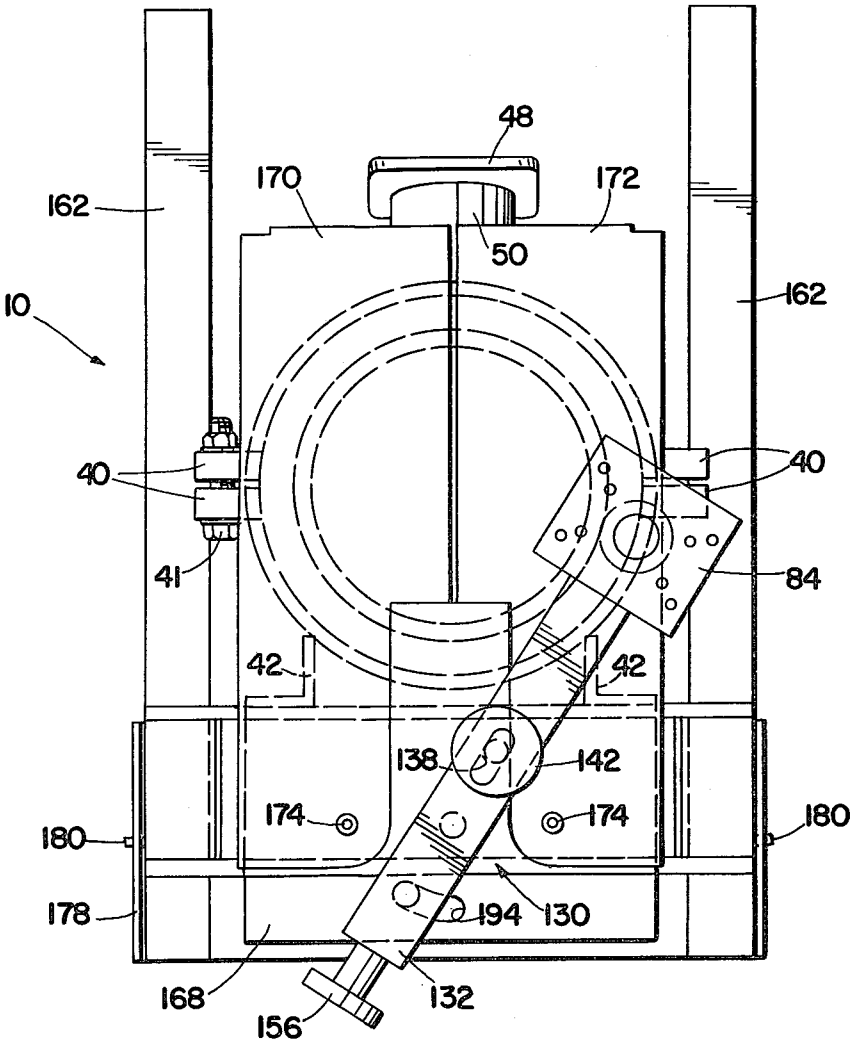
FIG. 3 is a view similar to FIG. 2, but with an actuator pivoted to a position permitting certain components of the device to be removed.
Figure 2:
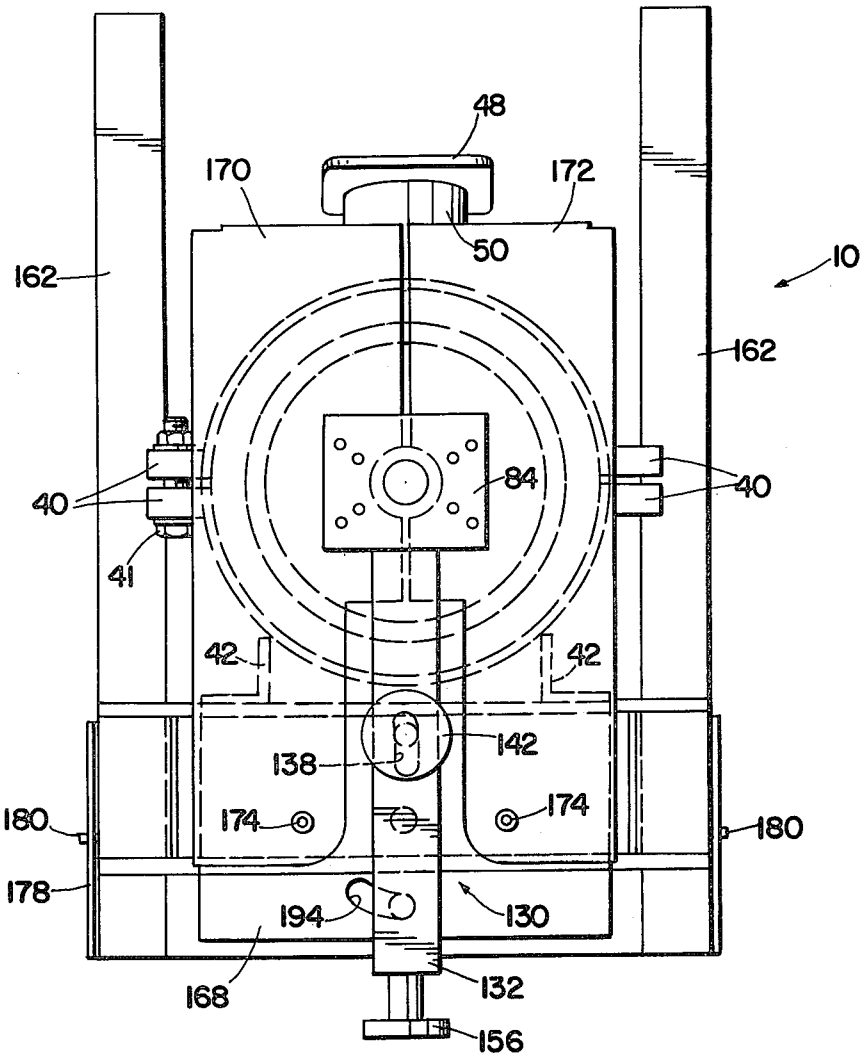
FIG. 2 is a top plan view of the device according to the invention.
Figure 4:
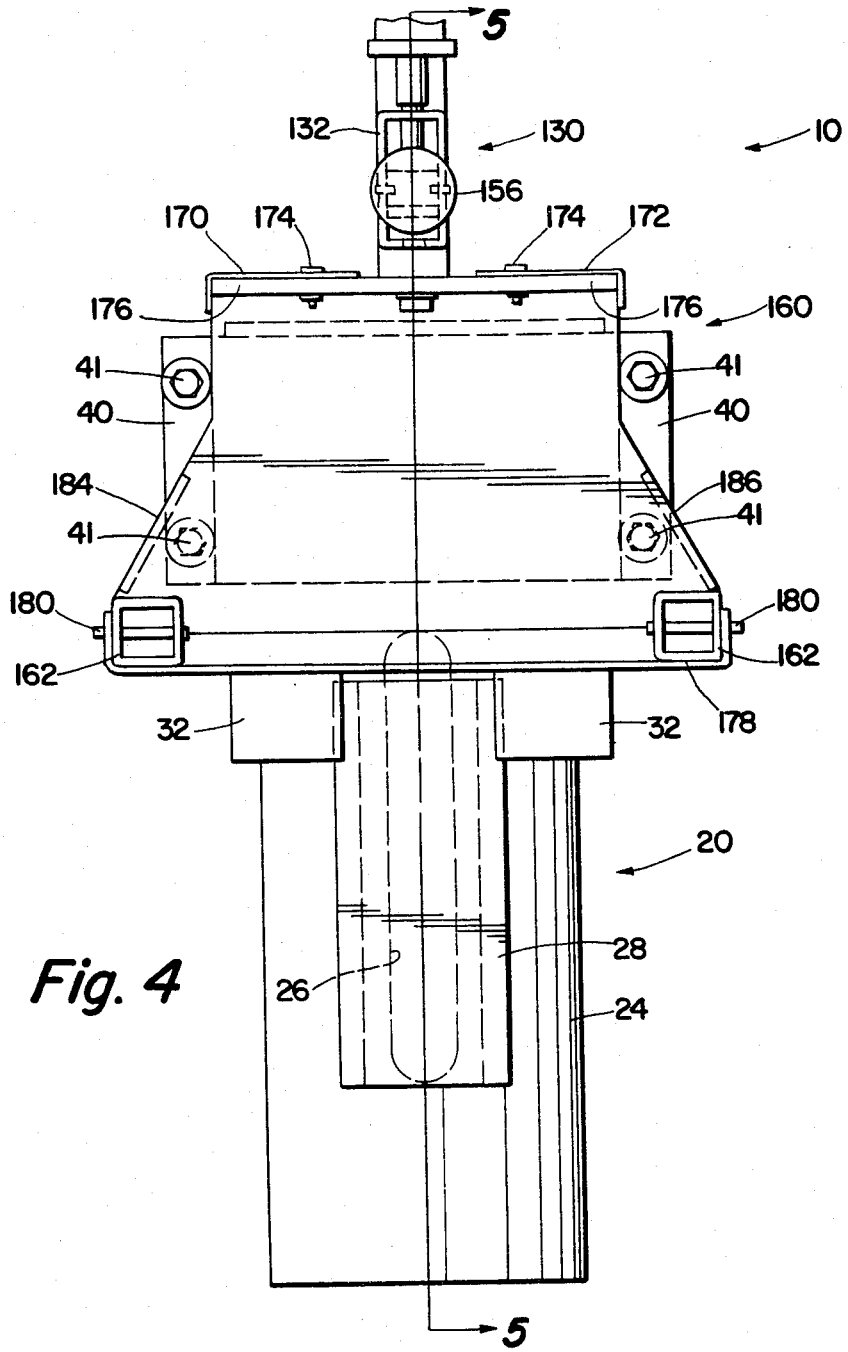
FIG. 4 is an end elevational view of the device according to the invention.

A shoulder bolt 188 extends through an opening in the outer guide bar 136 and is threadedly engaged with an opening in the inner guide bar 134. A longer shoulder bolt 190 extends through openings in the outer guide bar 136 and the mounting plate 168 and is threadedly engaged with an opening in the inner guide bar 134. The bolt 150 also serves as a pivot bolt and extends through openings in the plate 168 and the guide bars 136, 134 and is threadedly secured to the preload nut 148. The clamp screw 140 extends through openings in the guide bars 136, 138 and is threadedly engaged with an opening in the mounting plate 168. Referring particularly to FIGS. 2 and 3, the plate 168 also includes an arcuate opening 194 within which the shoulder bolt 190 is permitted to move.

VI. Alternative Structures

Referring particularly to FIGS. 7–14, several alternative structures are shown. The structures are illustrated schematically, and are not to any particular scale. Except insofar as the structures are described below, they are similar in function and operation to the first-described embodiment of the invention. The structures described below are useable in their entirety with remaining portions of the device 10 already described.

Figure 7:
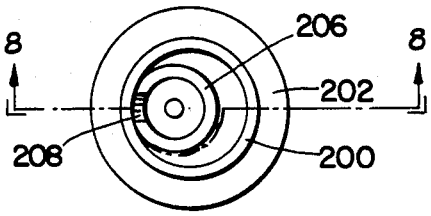
FIG. 7 is a schematic, top plan view of an alternative chamber-defining structure.
Figure 8:
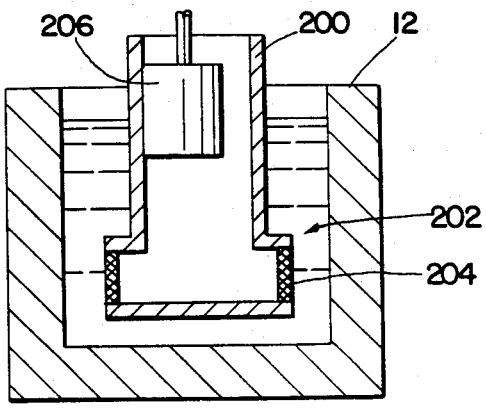
FIG. 8 is a cross-sectional view of the structure of FIG. 7, taken along a plane indicated by line 8—8 in FIG. 7.

The first alternative embodiment of the invention is shown in FIGS. 7 and 8. A structure 200 is disposed within the bath 12. The structure 200 includes an enlarged bottom portion 202 having a circumferential opening within which a porous filter medium 204 is disposed. A bucket 206 is disposed within the structure 200 for vertical reciprocating movement. Like the bucket 60, the bucket 206 includes a vertically extending slot 208. As has been described already, the bucket 206 is biased toward the structure 200 such that the bucket 206 in the region of the slot 208 is in contact with the structure 200.

The filter medium 204 consists of aluminum oxide particles bonded to each other. The porous filter medium is commercially available under the trademark ALOXITE.

Figure 9:
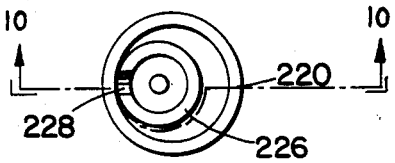
FIGS. 9–14 are schematic views of alternative chamber-defining structures, the views being similar to FIGS. 7 and 8.
Figure 10:
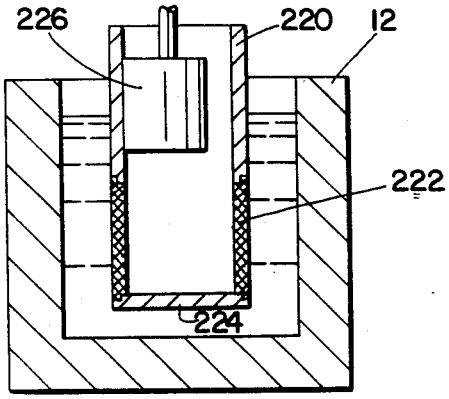

The remaining alternative embodiments illustrated in FIGS. 9–14 are similar to the one illustrated in FIGS. 7 and 8. Referring to FIGS. 9 and 10, a structure 220 is disposed within the bath 12. A cylindrical porous filter medium 222 is fitted to the bottom of the structure 220, and an end cap 224 closes the bottom of the porous filter medium 222. A bucket 226 having a slot 228 is disposed within the structure 220 for vertical reciprocating moement. As with the buckets 60, 206, the bucket 226 is urged toward the structure 220 such that the bucket 226 in the region of the slot 228 is brought into proximity with the structure 220.

Figure 11:
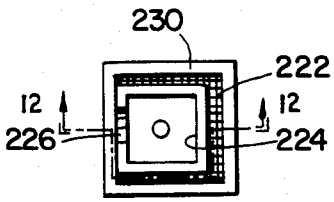
Figure 12:
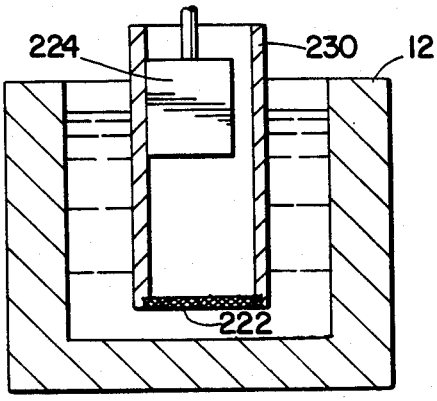

The embodiment shown in FIGS. 11 and 12 includes a structure 230 having a square cross-section. A porous filter medium 222 closes the bottom of the structure 230. A cube-like bucket 224 is disposed within the structure 230. The bucket 224 includes a slot 226. As with the other embodiments of the invention, the bucket 226 is biased toward the structure 230 such that the slot 226 is brought into proximity with the structure 230.

Figure 13:
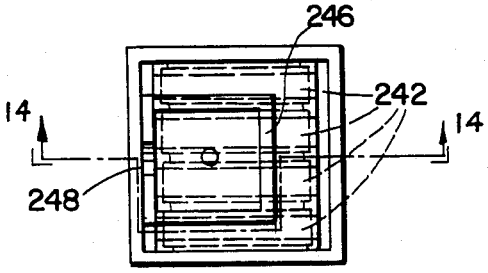
Figure 14:
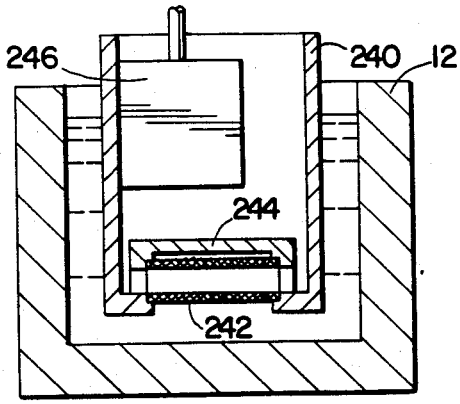

Referring to FIGS. 13 and 14, a structure 240 is disposed within the bath 12. Like the structure 230, the structure 240 is square in cross-section. A replaceable filter assembly consisting of cylindrical, porous inserts 242 is disposed at the bottom of the structure 240, and a cap 244 holds the inserts 242 in place.

A bucket 246 is disposed within the structure 240 for vertical reciprocating movement. The bucket 246 includes a vertically oriented slot 248 which, like the other bucket slots already described, is urged toward engagement with the structure 240. As with the other porous filter media already described, the inserts 242 are formed of ALOXITE brand aluminum oxide filter material.

In the embodiments shown in FIGS. 7–14, the spacing between the buckets 206, 226, 224, and 246 is such that molten metal is permitted to flow around the buckets due to the large gap between portions of the structures 200, 220, 230 and 240 and the respective buckets disposed within the structures. Such a construction avoids the need for providing the elongate first opening 26 provided for the first-described embodiment of the invention.

VII. Operation of the Device 10

When it is desired to operate the device 10, the following steps are carried out. It will be assumed that the components initially are in that position shown in FIG. 1.

1. The clamp screw 140 is loosened and the preload screw 146 is rotated clockwise as viewed in FIG. 4. Due to the interaction between the screw 146 and the nut 148, the tube 132 will be moved to the left as viewed in FIG. 5. In turn, the actuator 80 and the bucket 60 will be moved to the left as viewed in FIG. 5. Adjustment of the preload screw 146 should be continued in this manner until the gap between the surface of the chamber 22 and the bucket 60 in the region of slot 66 is within the range of 0.002 to 0.003 inch. Because a sealing function between the chamber 22 and the bucket 60 is necessary only in the region of the slot 66, the gap between the bucket 60 and remaining portions of the chamber 22 can be quite large, up to about one quarter inch.

2. Assuming that the bath 12 previously has been filled with molten metal, metal will flow into the chamber 22 through the first opening 26. Due to the presence of the downspout 28, metal will flow into the chamber 22 from beneath the surface, thereby substantially minimizing the amount of impurities carried by the metal entering the chamber 22. Eventually, the bucket 60 will be completely filled.

3. The pneumatic cylinder 82 will be actuated and the bucket 60 will be raised toward its uppermost position as shown by the dotted lines in FIG. 5. As the bucket 60 rises past the first opening 26, excess metal in the bucket 60 will be discharged through the first opening back into the bath 12. As the bucket 60 continues its upward movement, it will be completely filled to the upper edge.

4. As the bucket 60 approaches the second opening 30, metal will begin to flow outwardly of the second opening through the slot 66. The exact amount of material discharged from the bucket 60 will be dependent upon the uppermost position attained by the bucket 60. By loosening the bolt 124 and by appropriate vertical adjustment of the limit switch 116, the exact uppermost position attained by the bucket 60 can be adjusted quite easily. Because the width of the slot 66 is constant along its length, the amount of material discharged from the bucket 60 will be a linear function of the vertical position attained by the bucket 60.

This feature makes it easy for precise quantities of metal to be discharged from the bucket 60, and for those quantities to be adjusted as may be desired.

5. After a desired quantity of metal has been discharged from the bucket 60, the pneumatic cylinder 82 is activated so as to drive the bucket 60 downwardly back into the bath 12. Eventually that position shown in FIG. 1 will be attained, whereupon the bucket 60 will be filled once gain with metal and the cycle can be repeated.

6. If it is desired to remove the bucket 60 from the structure 20, it is necessary only that the set screws 114 be loosened and a wire passed through the opening 74 in the shaft 68 in order to keep the bucket 60 from falling out of the chamber 22. Upon lowering the shaft 68 slightly, the upper end of the necked-down portion 72 will clear the bottom end of the tube 92. Thereafter, upon removing the clamp screw 140 and loosening the bolt 190, the actuator 80 can be pivoted to that position shown in FIG. 3. Upon raising the shaft 68, the bucket 60 can be lifted out of the chamber 22.

7. If it should be desired to substitute either a new cylinder 24 or both a new cylinder 24 and a new bucket 60, it is necessary only that the steps described in the immediately preceding paragraph be carried out. Thereafter, the bolts 44 can be removed from the plate 164 and the entire structure 20 and bucket 60 can be removed. Another structure 20 and another bucket 60 then can be substituted and reconnected to the plate 164 with little difficulty. Upon pivoting the actuator 80 to that position shown in FIG. 2 and reconnecting the guide block 108 and the shaft 68, the device 10 is ready for use in a very short period of time.

As will be apparent from the foregoing description, a molten metal transfer device according to the invention enables the amount of material delivered by the device to be adjusted readily, and various components of the device can be substituted with minimal down time. Moreover, the invention provides important advantages as regards convenience and reliability.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a generally vertically oriented slot included as part of the sidewall of the bucket, the slot in use being positioned adjacent the second opening when the bucket is in the uppermost position, the slot enabling molten metal carried by the bucket to flow outwardly of the bucket through the second opening, the amount of metal flowing outwardly of the bucket being dependent upon the vertical position to which the bucket is displaced; and (f) means for requiring molten metal to enter the first opening from beneath the surface of the bath and preventing molten metal from entering the first opening from the surface of the bath.

2. The device of claim 1, wherein the chamber is cylindrical.

3. The device of claim 1, wherein the vertically oriented slot in the bucket extends from the bottom of the bucket to the upper edge of the bucket.

4. The device of claim 1, further comprising:

(a) an actuator connected to the bucket for causing the bucket to be reciprocated vertically; and (b) a limit switch included as part of the actuator, the limit switch being vertically adjustable so as to permit the uppermost position of the bucket to be adjusted.

5. The device of claim 1, further comprising:

(a) an actuator connected to the bucket for causing the bucket to be reciprocated vertically, the actuator being positioned above the bucket;

(b) means for connecting the bucket to the actuator, the means being separable so as to permit the selective disengagement of the bucket and the actuator; and, (c) means for moving the actuator laterally upon disconnection of the bucket and the actuator, whereby the bucket can be removed vertically from the chamber without interference from other components of the device.

6. The device of claim 1, wherein the first opening in the structure is in the form of a vertically oriented slot.

7. The device of claim 6, wherein the means for requiring molten metal to enter the first opening from beneath the surface of the bath and preventing molten metal from entering the first opening from the surface of the bath is in the form of a downspout secured to an outer portion of the structure, the downspout being disposed in superimposed relationship with respect to the first opening and spaced a short distance therefrom.

8. The device of claim 1, further comprising a biasing means for urging the bucket laterally toward engagement with the surface of the chamber.

9. The device of claim 8, wherein a gap formed between the bucket and the surface of the chamber created by the biasing means is within the range of approximately 0.002 to 0.003 inch.

10. The device of claim 8, wherein the biasing means includes:

(a) an actuator for causing the bucket to be reciprocated vertically; and (b) a displacement mechanism connected to the actuator for moving the actuator laterally relative to the structure.

11. The device of claim 10, wherein the displacement mechanism is in the form of a bolt threadedly engageable with a nut, a selected one of the bolt and the nut being connected to a stationary portion of the device and the other of the bolt and the nut being connected to the actuator whereby, upon relative movement between the nut and the bolt, the actuator and, hence, the bucket, can be moved laterally relative to the structure.

12. The device of claim 1, wherein the structure is secured to the remainder of the device by an encircling clamp, the clamp being removable to permit different structures to be used with the device without altering remaining components of the device.

13. The device of claim 12, additionally comprising:

(a) an actuator connected to the bucket for causing the bucket to be reciprocated vertically; and, (b) means for connecting the bucket to the actuator, the means being selectively disengageable to enable the structure and the bucket to be removed as a unit from the device.

14. The device of claim 1, further comprising a porous filter medium in communication with the first opening to enable solids entrained in the molten metal to be filtered.

15. The device of claim 14, wherein the filter medium is comprised of aluminumoxide particles.

16. The device of claim 1, additionally comprising heat insulating shields disposed about upper portions of the structure.

17. The device of claim 16, wherein the heat insulating shields are comprised of aluminosilicate fibers.

18. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a biasing means for urging the bucket laterally toward engagement with the surface of the chamber; and (f) means for requiring molten metal to enter the first opening from beneath the surface of the bath and preventing molten metal from entering the first opening from the surface of the bath.

19. The device of claim 18, wherein a gap formed between the bucket and the surface of the chamber created by the biasing means is within the range of approximately 0.002 to 0.003 inch.

20. The device of claim 18, further comprising:

(a) an actuator connected to the bucket for causing the bucket to be reciprocated vertically; and (b) a limit switch included as part of the actuator, the limit switch being vertically adjustable so as to permit the uppermost position of the bucket to be adjusted.

21. The device of claim 18, further comprising:

(a) an actuator connected to the bucket for causing the bucket to be reciprocated vertically, the actuator being positioned above the bucket;

(b) means for connecting the bucket to the actuator, the means being separable so as to permit the selective disengagement of the bucket and the actuator; and, (c) means for moving the actuator laterally upon disconnection of the bucket and the actuator whereby the bucket can be removed vertically from the chamber without interference from other components of the device.

22. The device of claim 18, wherein the biasing means includes:

(a) an actuator for causing the bucket to be reciprocated vertically; and (b) a displacement mechanism connected to the actuator for moving the actuator laterally relative to the structure.

23. The device of claim 22, wherein the displacement mechanism is in the form of a bolt threadedly engageable with a nut, a selected one of the bolt and the nut being connected to a stationary portion of the device and the other of the bolt and the nut being connected to the actuator whereby, upon relative movement between the nut and the bolt, the actuator and, hence, the bucket, can be moved laterally relative to the structure.

24. The device of claim 18, additionally including a vertically oriented slot formed in the sidewall of the bucket, the slot being positioned relative to the second opening such that liquid carried by the bucket can be discharged outwardly through the slot and through the second opening.

25. The device of claim 24, wherein the slot extends from the bottom of the bucket to the upper edge of the bucket.

26. The device of claim 18, wherein the first opening in the structure is in the form of a vertically oriented slot.

27. The device of claim 26, additionally comprising a downspout secured to an outer portion of the structure, the downspout being disposed in superimposed relationship with respect to the first opening and spaced a short distance therefrom, the downspout extending into the bath a sufficient distance that molten metal entering the chamber is required to flow from beneath the surface of the bath.

28. The device of claim 18, wherein the structure is secured to the remainder of the device by an encircling clamp, the clamp being removable to permit different structures to be used with the device without altering remaining components of the device.

29. The device of claim 28, additionally comprising:

(a) an actuator connected to the bucket for causing the bucket to be reciprocated vertically; and, (b) means for connecting the bucket to the actuator, the means being selectively disengagable to enable the structure and the bucket to be removed as a unit from the device.

30. The device of claim 18, further comprising a porous filter medium in communication with the first opening to enable solids entrained in the molten metal to be filtered.

31. The device of claim 30, wherein the filter medium is comprised of aluminum oxide particles.

32. The device of claim 18 additionally comprising insulating heat shields disposed about upper portions of the structure.

33. The device of claim 32, wherein the heat insulating shields are comprised of aluminosilicate fibers.

34. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening in the form of a vertically oriented slot included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a generally vertically oriented slot included as part of the sidewall of the bucket, the slot in use being positioned adjacent the second opening when the bucket is in the uppermost position, the slot enabling molten metal carried by the bucket to flow outwardly of the bucket through the second opening, the amount of metal flowing outwardly of the bucket being dependent upon the vertical position to which the bucket is displaced; and (f) a downspout secured to an outer portion of the structure, the downspout being disposed in superimposed relationship with respect to the first opening and spaced a short distance therefrom, the downspout extending into the bath a sufficient distance that molten metal entering the chamber is required to flow from beneath the surface of the bath.

35. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a generally vertically oriented slot included as part of the sidewall of the bucket, the slot in use being positioned adjacent the second opening when the bucket is in the uppermost position, the slot enabling molten metal carried by the bucket to flow outwardly of the bucket through the second opening, the amount of metal flowing outwardly of the bucket being dependent upon the vertical position to which the bucket is displaced; and (f) a biasing means for urging the bucket laterally toward engagement with the surface of the chamber, the biasing means including an actuator for causing the bucket to be reciprocated vertically and a displacement mechanism connected to the actuator for moving the actuator laterally relative to the structure.

36. The device of claim 35, wherein the displacement mechanism is in the form of a bolt threadedly engageable with a nut, a selected one of the bolt and the nut being connected to a stationary portion of the device and the other of the bolt and the nut being connected to the actuator whereby, upon relative movement between the nut and the bolt, the actuator and, hence, the bucket, can be moved laterally relative to the structure.

37. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a generally vertically oriented slot included as part of the sidewall of the bucket, the slot in use being positioned adjacent the second opening when the bucket is in the uppermost position, the slot enabling molten metal carried by the bucket to flow outwardly of the bucket through the second opening, the amount of metal flowing outwardly of the bucket being dependent upon the vertical position to which the bucket is displaced;

(f) an actuator connected to the bucket for causing the bucket to be reciprocated vertically, the actuator being positioned above the bucket;

(g) means for connecting the bucket to the actuator, the means being separable so as to permit the selective disengagement of the bucket and the actuator; and (h) means for moving the actuator laterally upon disconnection of the bucket and the actuator, whereby the bucket can be removed vertically from the chamber without interference from other components of the device.

38. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a generally vertically oriented slot included as part of the sidewall of the bucket, the slot in use being positioned adjacent the second opening when the bucket is in the uppermost position, the slot enabling molten metal carried by the bucket to flow outwardly of the bucket through the second opening, the amount of metal flowing outwardly of the bucket being dependent upon the vertical position to which the bucket is displaced;

(f) the structure being secured to the remainder of the device by an encircling clamp, the clamp being removable to permit different structures to be used with the device without altering remaining components of the device;

(g) an actuator connected to the bucket for causing the bucket to be reciprocated vertically; and (h) means for connecting the bucket to the actuator, the means being selectively disengagable to enable the structure and the bucket to be removed as a unit from the device.

39. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening; and (e) a biasing means for urging the bucket laterally toward engagement with the surface of the chamber, the biasing means including an actuator for causing the bucket to be reciprocated vertically and a displacement mechanism connected to the actuator for moving the actuator laterally relative to the structure.

40. The device of claim 39, wherein the displacement mechanism is in the form of a bolt threadedly engageable with a nut, a selected one of the bolt and the nut being connected to a stationary portion of the device of the other of the bolt and the nut being connected to the actuator whereby, upon relative movement between the nut and the bolt, the actuator and, hence, the bucket, can be moved laterally relative to the structure.

41. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening in the form of a vertically oriented slot included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a biasing means for urging the bucket laterally toward engagement with the surface of the chamber; and (f) a downspout secured to an outer portion of the structure, the downspout being disposed in superimposed relationship with respect to the first opening and spaced a short distance therefrom, the downspout extending into the bath a sufficient distance that molten metal entering the chamber is required to flow from beneath the surface of the bath.

42. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a biasing means for urging the bucket laterally toward engagement with the surface of the chamber;

(f) an actuator connected to the bucket for causing the bucket to be reciprocated vertically, the actuator being positioned above the bucket;

(g) means for connecting the bucket to the actuator, the means being separable so as to permit the selective disengagement of the bucket and the actuator; and (h) means for moving the actuator laterally upon disconnection of the bucket and the actuator whereby the bucket can be removed vertically from the chamber without interference from other components of the device.

43. A molten metal transfer device for withdrawing a selected quantity of molten metal from a bath, comprising:

(a) structure defining a chamber, a portion of the chamber being disposed within the bath, the chamber being oriented generally vertically and positioned relative to the bath such that a portion of the chamber is disposed beneath the surface of the molten metal and a portion of the chamber is disposed above the surface of the molten metal;

(b) a first opening included as part of the structure through which molten metal can flow from the bath into the chamber;

(c) a second opening included as part of the structure through which molten metal can flow outwardly from the chamber, the second opening being located at a vertical position above that of the first opening;

(d) a cup-like bucket disposed within the chamber for vertical reciprocating movement therein, the bucket having a sidewall and a bottom, the bucket at its lowermost position being at or below the level of the first opening and at its uppermost position being above the level of the first opening;

(e) a biasing means for urging the bucket laterally toward engagement with the surface of the chamber;

(f) the structure secured to the remainder of the device by an encircling clamp, the clamp being removable to permit different structures to be used with the device without altering remaining components of the device;

(g) an actuator connected to the bucket for causing the bucket to be reciprocated vertically; and, (h) means for connecting the bucket to the actuator, the means being selectively disengagable to enable the structure and the bucket to be removed as a unit from the device.

* * * * *